US006644287B2

(12) United States Patent
Onishi et al.

(10) Patent No.: US 6,644,287 B2
(45) Date of Patent: Nov. 11, 2003

(54) HIGH PRESSURE FUEL SUPPLY APPARATUS

(75) Inventors: Yoshihiko Onishi, Tokyo (JP); Kouichi Ojima, Tokyo (JP); Yuta Ichinose, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 63 days.

(21) Appl. No.: 10/118,159

(22) Filed: Apr. 9, 2002

(65) Prior Publication Data

US 2003/0056765 A1 Mar. 27, 2003

(30) Foreign Application Priority Data

Sep. 27, 2001 (JP) ..... 2001-295849

(51) Int. Cl.[7] ..... F02M 37/04
(52) U.S. Cl. ..... 123/495
(58) Field of Search ..... 123/495, 506

(56) References Cited

U.S. PATENT DOCUMENTS 6,223,724 B1 * 5/2001 Miyaji et al. ..... 123/446
2003/0056768 A1 * 3/2003 Onishi et al. ..... 123/506

FOREIGN PATENT DOCUMENTS

JP 2000-45906 A 2/2000

* cited by examiner

*Primary Examiner*—Thomas N. Moulis
(74) *Attorney, Agent, or Firm*—Sughrue Mion, PLLC

(57) ABSTRACT

There is provided a high pressure fuel supply apparatus including a plunger reciprocating in a sleeve of a high pressure fuel pump so as to form a fuel pressurizing chamber between the plunger and the sleeve, a first plate having a fuel suction port for sucking fuel into the fuel pressurizing chamber and a fuel discharge port for discharging the fuel from the fuel pressurizing chamber, and a suction valve provided in the fuel suction port, the first plate, the suction valve and a flange portion of the sleeve being held between a casing and an end surface of a spring guide constituting the high pressure fuel pump.

6 Claims, 8 Drawing Sheets

HIGH PRESSURE FUEL SUPPLY APPARATUS

BACKGROUND OF THE INVENTION

The present invention relates to a high pressure fuel supply apparatus chiefly for use in a cylinder fuel injection engine or the like.

FIG. 11 is a block diagram showing a fuel supply system in an internal combustion engine for a vehicle, including a conventional high pressure fuel supply apparatus. In FIG. 11, fuel 2 in a fuel tank 1 is delivered from the fuel tank 1 by a low pressure pump 3, passes through a filter 4, is adjusted in pressure by a low pressure regulator 5, and then is supplied to a high pressure fuel supply apparatus 6 which is a high pressure pump. A flow rate of the fuel 2 exactly required for fuel injection is boosted by the high pressure fuel supply apparatus 6, and supplied into a delivery pipe 9 of the not-shown internal combustion engine. A surplus of the fuel 2 is relieved between a low pressure damper 12 and a suction valve 13 by an electromagnetic valve 17.

In addition, the required fuel flow rate is determined by a not-shown control unit, which also controls the electromagnetic valve 17. The high pressure fuel supplied thus is injected into a cylinder of the internal combustion engine in the form of high pressure mist from a fuel injection valve 10 connected to the delivery pipe 9. When abnormal pressure (high-pressure relieving valve opening pressure power) is produced in the delivery pipe 9, a filter 7 and a high pressure relief valve 8 are opened to prevent the delivery pipe 9 from being broken.

The high pressure fuel supply apparatus 6 which is a high pressure pump, has a filter 11 for filtering the supplied fuel, the low pressure damper 12 for absorbing the pulsation of the low pressure fuel, and a high pressure fuel pump 16 for pressurizing the fuel supplied through the suction valve 13 and discharging the high pressure fuel through a discharge valve 14.

FIG. 12 is a sectional view showing a conventional high pressure fuel supply apparatus. In FIG. 12, the high pressure fuel supply apparatus 6 is integrally provided with a casing 61, a high pressure fuel pump 16, an electromagnetic valve 17, and a low pressure damper 12. The high pressure fuel pump 16 is a plunger pump provided in the casing 61.

A fuel pressurizing chamber 163 surrounded by a sleeve 160 and an end of a plunger 161 inserted slidably in the sleeve 160 is formed in the high pressure fuel pump 16. The other end of the plunger 161 abuts against a tappet 164, and the tappet 164 is brought into contact with a cam 100 so as to drive the high pressure fuel pump 16. The cam 100 is provided integrally or coaxially with a cam shaft 101 of the engine so as to reciprocate the plunger 161 along the profile of the cam 100 in cooperation with the rotation of a crank shaft of the engine. The volume of the fuel pressurizing chamber 163 is changed by the reciprocating motion of the plunger 161 so that the fuel boosted to high pressure is discharged from the discharge valve 14.

In the high pressure fuel pump 16, a first plate 162, the suction valve 13, a second plate 166 and a flange portion 160*a* of the sleeve 160 are held between the casing 61 and an end surface of a spring guide 165, and fastened with a bolt 180. The first plate 162 forms a fuel suction port 162*a* for sucking fuel from the low pressure damper 12 to the fuel pressurizing chamber 163, and a fuel discharge port 162*b* for discharging the fuel from the fuel pressurizing chamber 163.

The suction valve 13 shaped into a thin plate is held between the first plate 162 and the second plate 166 so that a valve is formed in the fuel suction port 162*a*. The discharge valve 14 is provided on an upper portion of the fuel discharge port 162*b* so as to communicate with the delivery pipe 9 through a high pressure fuel discharge passageway 62 provided in the casing 61. In addition, in order to suck fuel, a spring 167 for pushing the plunger 161 down in a direction to expand the fuel pressurizing chamber 163 is disposed in the state where the spring 167 has been compressed between the spring guide 165 and a spring holder 168.

The electromagnetic valve 17 has an electromagnetic valve body 170, a valve seat 173, a valve 174, and a compression spring 175. The electromagnetic valve body 170 is incorporated in the casing 61 of the high pressure fuel supply apparatus 6 so as to have a fuel channel 172 inside the electromagnetic valve body 170. The valve seat 173 is provided in the fuel channel 172 of the electromagnetic valve body 170. The valve 174 is separated from/brought near to the valve seat 173 in the electromagnetic valve body 170 so as to open/close the fuel channel 172. The compression spring 175 presses the valve 174 onto the valve seat 173.

At a point of time when a flow rate requested from a not-shown control unit has been discharged in a discharge stroke of the high pressure fuel pump 16, a solenoid coil 171 of the electromagnetic valve 17 is excited to open the valve 174. Thus, the fuel 2 in the fuel pressurizing chamber 163 is released to the low pressure side between the low pressure damper 12 and the suction valve 13 so that the pressure in the fuel pressurizing chamber 163 is reduced to be not higher than the pressure in the delivery pipe 9. Thus, the discharge valve 14 is closed. After that, the valve 174 of the electromagnetic valve 17 is opened till the high pressure fuel pump 16 proceeds to a suction stroke. The timing to open the electromagnetic valve 17 is controlled so that the amount of fuel discharged into the delivery pipe 9 can be adjusted.

However, the conventional high pressure fuel supply apparatus has problems as follows. FIG. 13 is a sectional view in which the vicinity of the flange portion 160*a* (inside the circle in FIG. 12) of the sleeve 160 in the high pressure fuel pump of the conventional high pressure fuel supply apparatus is enlarged in scale. As shown in FIG. 13, the flange portion 160*a* of the sleeve 160 and the end surface of the spring guide 165 abut against each other flatly over a range from their inner circumferential portions to their outer circumferential portions.

FIG. 14 is a graph showing the surface pressure distribution between portions a and b which are respective contact portions between the flange portion 160*a* of the sleeve 160 and the second plate 166 in FIG. 13. In FIG. 14, the ordinate of the graph designates the surface pressure distribution (MPa), and the abscissa designates the radial length between the contact portions a and b. As shown in FIG. 14, it is understood that the surface pressure distribution appearing between the contact portions a and b shows a maximum in the outer circumferential portion, and becomes lower as it approaches the inner circumferential portion, that is, the fuel pressurizing chamber 163. Therefore, in the case where the fuel pressure is high (for example, about 15 MPa), there is a problem that fuel leaks through a gap produced in the inner circumferential portion in the contact portion between the flange portion 160*a* and the second plate 166 so that the discharge quantity of the fuel lowers suddenly. In addition, there is another problem that wear due to fretting is produced in the portion of the contact portions a and b where the surface pressure is lowered.

On the other hand, in order to prevent the deformation of the sleeve 160, there are taken such measures that the sleeve 160 and the second plate 166 are thickened, or the fastening torque of the fastening bolt is increased. However, there arises a new problem that the apparatus is increased in dimensions because the sleeve 160 and the second plate 166 are thickened, or the apparatus is increased in dimensions or in weight because the casing 61 and the fastening bolt are increased in rigidity or a high-strength material is adopted (the material is changed from normally used aluminum to iron) in order to increase the fastening torque of the fastening bolt.

SUMMARY OF THE INVENTION

The present invention is developed to solve the foregoing problems. It is an object of the present invention to provide a small-size and light-weight high pressure fuel supply apparatus in which lowering of a flow rate of fuel when the fuel is in high pressure, and wear due to fretting are prevented.

According to the present invention, there is provided a high pressure fuel supply apparatus including a plunger reciprocating in a sleeve of a high pressure fuel pump so as to form a fuel pressurizing chamber between the plunger and the sleeve, a first plate having a fuel suction port for sucking fuel into the fuel pressurizing chamber and a fuel discharge port for discharging the fuel from the fuel pressurizing chamber, and a suction valve provided in the fuel suction port, the first plate, the suction valve and a flange portion of the sleeve being held between a casing and an end surface of a predetermined member constituting the high pressure fuel pump, wherein an outer circumferential portion of the end surface of the predetermined member and an outer circumferential portion of the flange portion of the sleeve are designed not to abut against each other in a contact portion between the end portion of the predetermined member and the flange portion of the sleeve.

DETAILED DESCRIPTION OF THE PREFERRED EMBODIMENTS (Embodiment 1)

Figure 1:
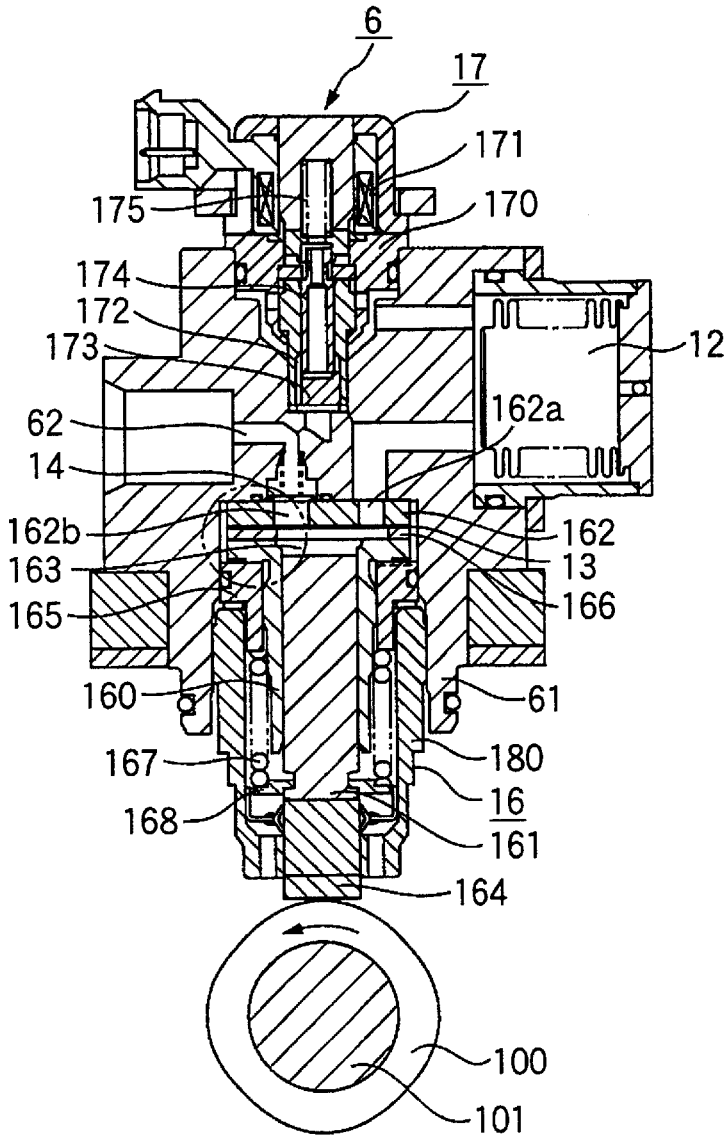
FIG. 1 is a sectional view showing a high pressure fuel supply apparatus according to Embodiment 1 of the present invention.
Figure 2:
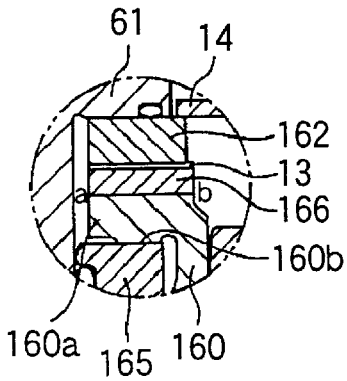
FIG. 2 is a sectional view in which the vicinity of a sleeve flange in a high pressure fuel pump of the high pressure fuel supply apparatus according to Embodiment 1 of the present invention is enlarged in scale.

FIG. 1 is a sectional view showing a high pressure fuel supply apparatus according to Embodiment 1 of the present invention. FIG. 2 is a sectional view in which the vicinity of a sleeve flange (inside the circle) in a high pressure fuel pump in FIG. 1 is enlarged in scale. Incidentally, here, a fuel supply system including this high pressure fuel supply apparatus is basically similar to that in the above-mentioned conventional example, and detailed description thereof will be omitted. In addition, the configuration of an electromagnetic valve 17 is basically similar to that in the conventional example, and detailed description thereof will be omitted. In FIG. 1, a high pressure fuel supply apparatus 6 is integrally provided with a casing 61, a high pressure fuel pump 16, an electromagnetic valve 17 and a low pressure damper 12. The high pressure fuel pump 16 is a plunger pump provided inside the casing 61.

A fuel pressurizing chamber 163 surrounded by a sleeve 160 and an end of a plunger 161 inserted slidably in the sleeve 160 is formed in the high pressure fuel pump 16. A tappet 164 abuts against the other end of the plunger 161. The tappet 164 is brought into contact with a cam 100 so as to drive the high pressure fuel pump 16. The cam 100 is provided integrally or coaxially with a cam shaft 101 of the engine so as to reciprocate the plunger 161 along the profile of the cam 100 in cooperation with the rotation of a crank shaft of the engine. The volume of the fuel pressurizing chamber 163 is changed by the reciprocating motion of the plunger 161 so that the fuel boosted to high pressure is discharged from a discharge valve 14.

In the high pressure fuel pump 16, a first plate 162, a suction valve 13, a second plate 166 and a flange portion 160*a* of the sleeve 160 are held between the casing 61 and an end surface of a spring guide 165 as a predetermined member constituting the high pressure fuel pump 16, and fastened with a bolt 180. The first plate 162 forms a fuel suction port 162*a* for sucking fuel from the low pressure damper 12 to the fuel pressurizing chamber 163, and a fuel discharge port 162*b* for discharging the fuel from the fuel pressurizing chamber 163.

The suction valve 13 shaped into a thin plate is held between the first plate 162 and the second plate 166 so that a valve is formed in the fuel suction port 162*a*. The discharge valve 14 is provided on an upper portion of the fuel discharge port 162*b* so as to communicate with a delivery pipe 9 through a high pressure fuel discharge passageway 62 provided in the casing 61. In addition, in order to suck fuel, a spring 167 for pushing the plunger 161 down in a direction to expand the fuel pressurizing chamber 163 is disposed in the state where the spring 167 has been compressed between the spring guide 165 and a spring holder 168.

In this embodiment, as shown in FIG. 2, a contact portion 160*b* is provided in an inner circumferential portion of the flange portion 160*a* of the sleeve 160. Thus, the flange portion 160*a* is designed to abut against the spring guide 165 only through this contact portion 160*b* so that an end surface of the spring guide 165 and an outer circumferential portion of the flange portion 160*a* are prevented from abutting against each other. As a result, the surface pressure distribution between the flange portion 160*a* of the sleeve 160 and the second plate 166 can be made uniform between contact portions a and b.

Figure 3:
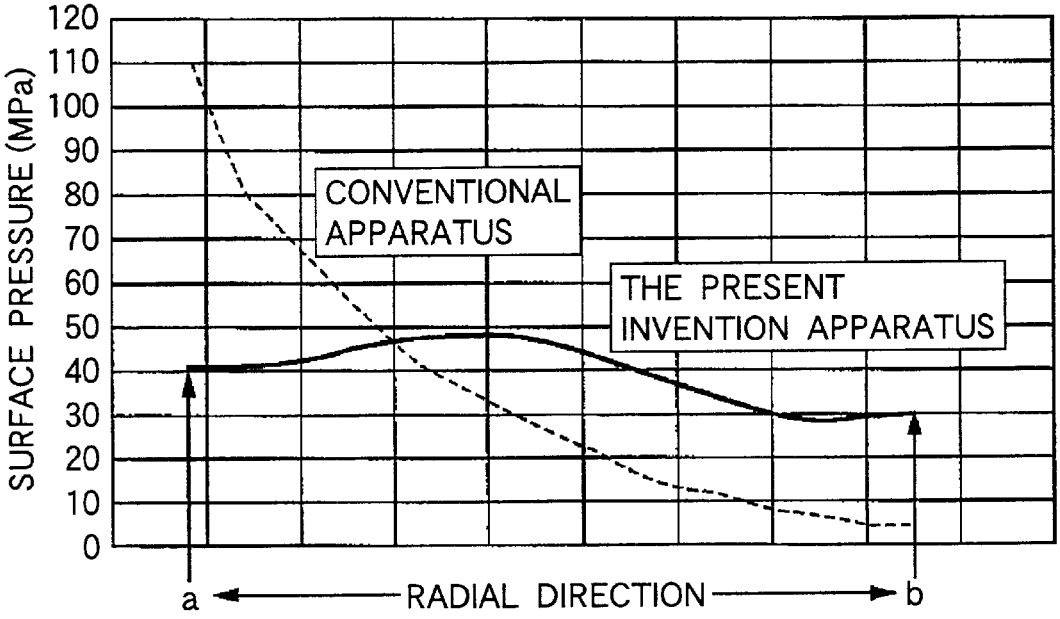
FIG. 3 is a graph showing the surface pressure distribution of a plate in the high pressure fuel pump of the high pressure fuel supply apparatus according to Embodiment 1 of the present invention, and that in a high pressure fuel pump of a conventional high pressure fuel supply apparatus.
Figure 14:
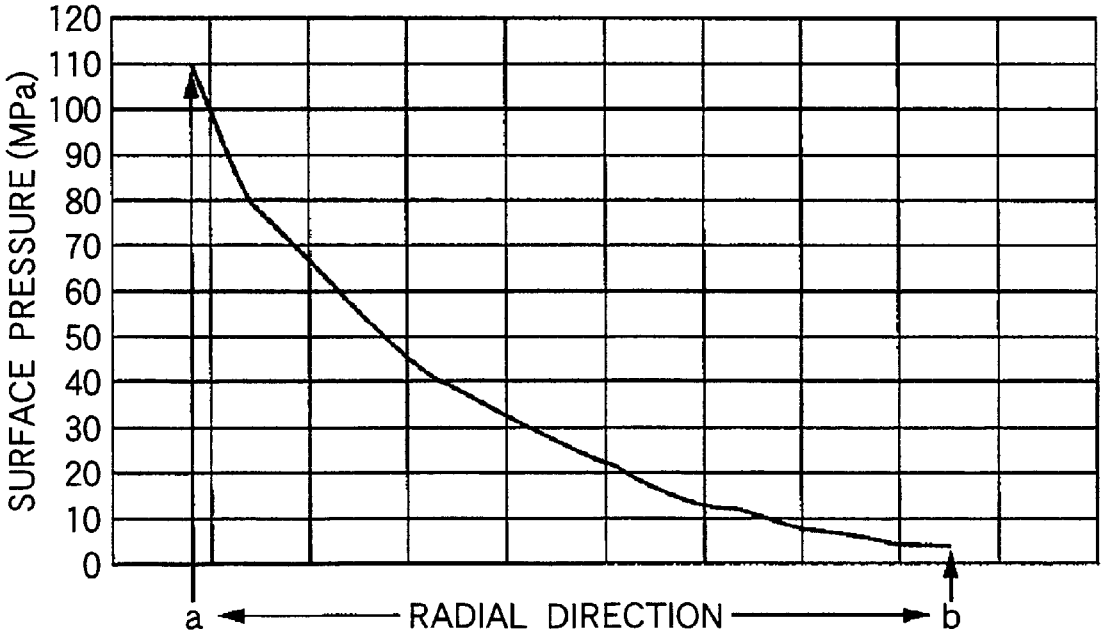
FIG. 14 is a graph showing the surface pressure distribution of a plate in the high pressure fuel pump of the conventional high pressure fuel supply apparatus.

FIG. 3 is a graph showing the surface pressure distribution between portions a and b which are respective contact portions between the flange portion 160*a* of the sleeve 160 and the second plate 166 in FIG. 1. In FIG. 3, the ordinate of the graph designates the surface pressure distribution (MPa), and the abscissa designates the radial length between the contact portions a and b. In addition, the solid line designates a high pressure fuel pump according to this embodiment, and the dotted line designates a high pressure fuel pump in the above-mentioned conventional example (the same as that in FIG. 14).

As shown in FIG. 3, it is understood that in comparison with the above-mentioned conventional example, the surface pressure distribution according to this embodiment is low in the outer circumferential portion and becomes higher as it approaches the inner circumferential portion, that is, the fuel pressurizing chamber 163, so that the surface pressure distribution becomes uniform between the contact portions a and b. Accordingly, even if the fuel pressure is high, the leakage of fuel through a gap produced in the inner circumferential portion in the contact portion between the flange portion 160*a* and the second plate 166 is prevented so that the lowering of the discharge quantity of the fuel can be restrained.

In addition, unlike the conventional example, this can be attained without taking such measures that the sleeve 160 and the second plate 166 are thickened, or a high-strength material is adopted to increase the fastening torque of the fastening bolt. Thus, it can contribute to down sizing and weight reduction of the high pressure fuel supply apparatus. In addition, because the surface pressure between the flange portion 160*a* and the second plate 166 is uniform between the contact portions a and b, it is possible to reduce the wear caused by fretting.

Figure 4:
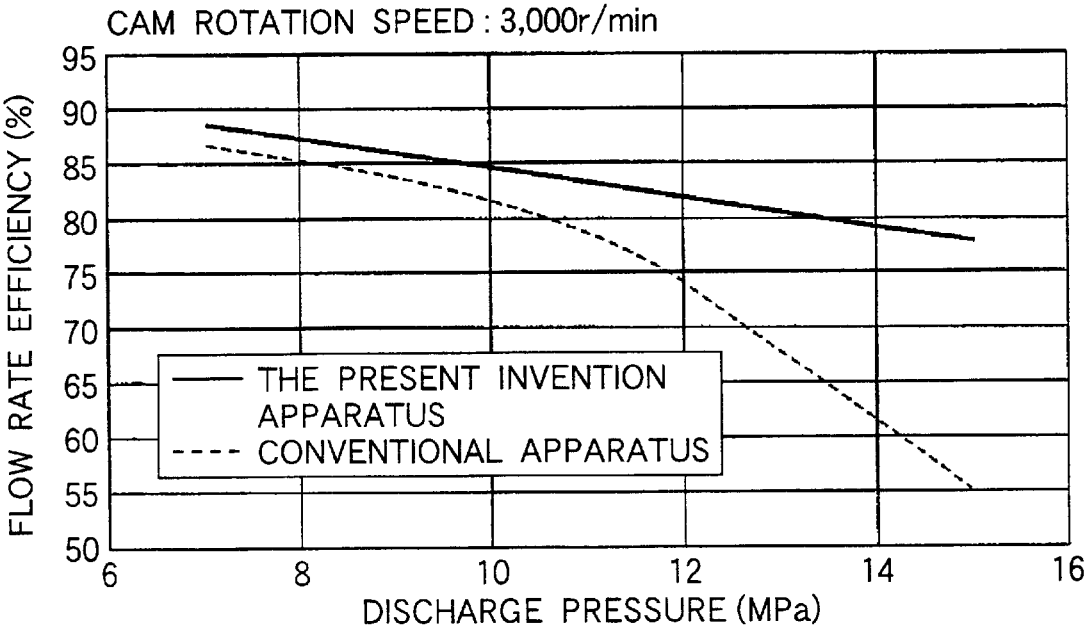
FIG. 4 is a graph showing the relationship between the flow rate efficiency and the discharge pressure in the high pressure fuel pump of the high pressure fuel supply apparatus according to Embodiment 1 of the present invention, and that in a high pressure fuel pump of a conventional high pressure fuel supply apparatus.

FIG. 4 is a graph showing the relationship between the flow rate efficiency and the discharge pressure in the high pressure fuel pump of the high pressure fuel supply apparatus according to Embodiment 1 of the present invention, and that in the high pressure fuel pump of the conventional high pressure fuel supply apparatus. In FIG. 4, the ordinate of the graph designates the flow rate efficiency (real flow rate/theoretical discharge flow rate ×100%, the theoretical discharge quantity is herein diameter of sleeve 160×lifting capacity of discharge valve 14), and the abscissa designates the discharge pressure (MPa). In addition, the solid line designates the high pressure fuel pump according to this embodiment, and the dotted line designates the high pressure fuel pump in the above-mentioned conventional example. In addition, the rotation speed of the cam 100 is 3,000 r/min. As shown in FIG. 4, it is understood that in comparison with that in the conventional example, the flow rate efficiency according to this embodiment is improved, and the difference in the flow rate efficiency becomes more conspicuous particularly as the discharge pressure becomes higher. Thus, the leakage of fuel through a gap produced in the inner circumferential portion in the contact portion between the flange portion 160*a* and the second plate 166 is prevented so that the lowering of the discharge quantity of the fuel is restrained.

(Embodiment 2)

Figure 5:
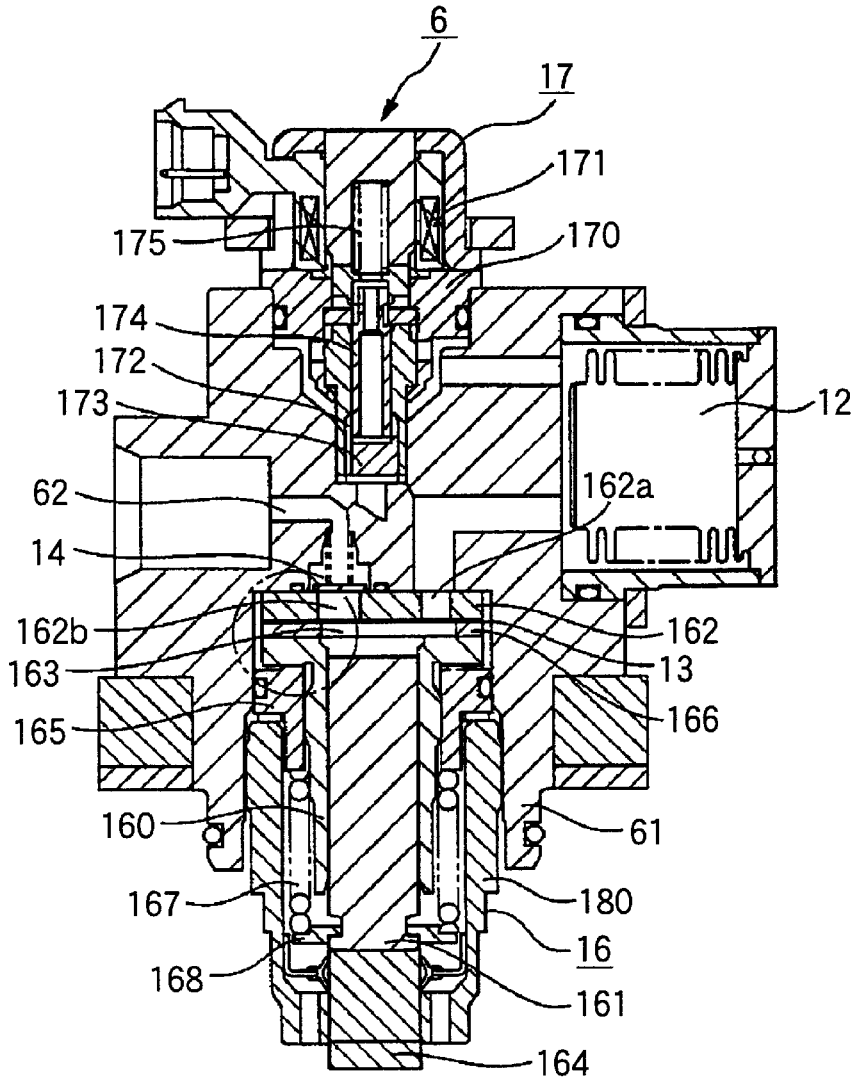
FIG. 5 is a sectional view showing a high pressure fuel supply apparatus according to Embodiment 2 of the present invention.
Figure 6:
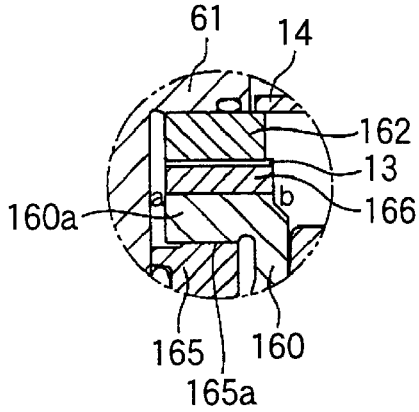
FIG. 6 is a sectional view in which the vicinity of a sleeve flange in a high pressure fuel pump of the high pressure fuel supply apparatus according to Embodiment 2 of the present invention is enlarged in scale.

FIG. 5 is a sectional view showing a high pressure fuel supply apparatus according to Embodiment 2 of the present invention. FIG. 6 is a sectional view in which the vicinity of a sleeve flange (inside the circle) in a high pressure fuel pump in FIG. 5 is enlarged in scale. As shown FIG. 6, in this embodiment, a contact portion 165*a* is provided in an inner circumferential portion of a spring guide 165. Thus, the spring guide 165 is designed to abut against a flange portion 160*a* of a sleeve 160 only through this contact portion 165*a* so that an end surface of the spring guide 165 and an outer circumferential portion of the flange portion 160*a* are prevented from abutting against each other. As a result, it is possible to obtain an effect similar to that in Embodiment 1.

(Embodiment 3)

Figure 7:
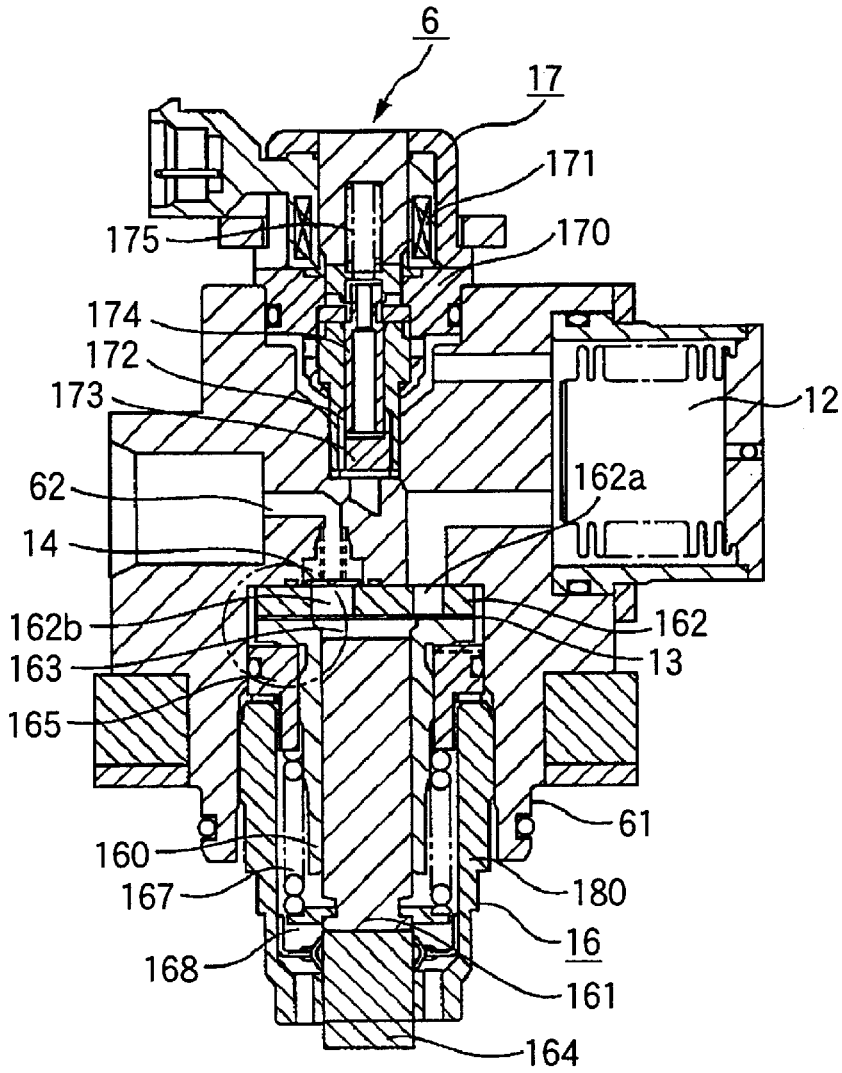
FIG. 7 is a sectional view showing a high pressure fuel supply apparatus according to Embodiment 3 of the present invention.
Figure 8:
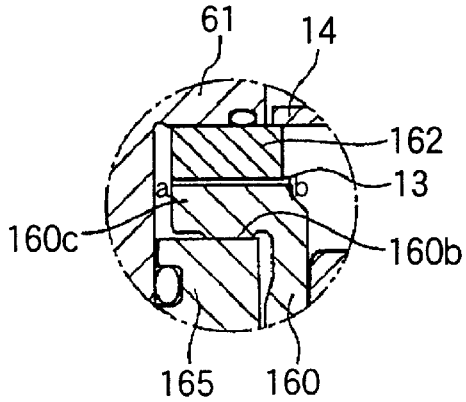
FIG. 8 is a sectional view in which the vicinity of a sleeve flange in a high pressure fuel pump of the high pressure fuel supply apparatus according to Embodiment 3 of the present invention is enlarged in scale.

FIG. 7 is a sectional view showing a high pressure fuel supply apparatus according to Embodiment 3 of the present invention. FIG. 8 is a sectional view in which the vicinity of a sleeve flange (inside the circle) in a high pressure fuel pump in FIG. 7 is enlarged in scale. As shown FIG. 8, the flange portion 160*a* of the sleeve 160 and the second plate 166 in the high pressure fuel pump in Embodiment 1 are integrally formed into a flange portion 160*c* in this embodiment. As a result, the surface pressure between a suction valve 13 and the flange portion 160*c* of the sleeve 160 can be made uniform between contact portions a and b. Thus, it is possible to obtain an effect similar to that in Embodiment 1, while the cost can be reduced due to reduction in the number of parts, and the number of portions from which fuel may leak can be reduced.

(Embodiment 4)

Figure 9:
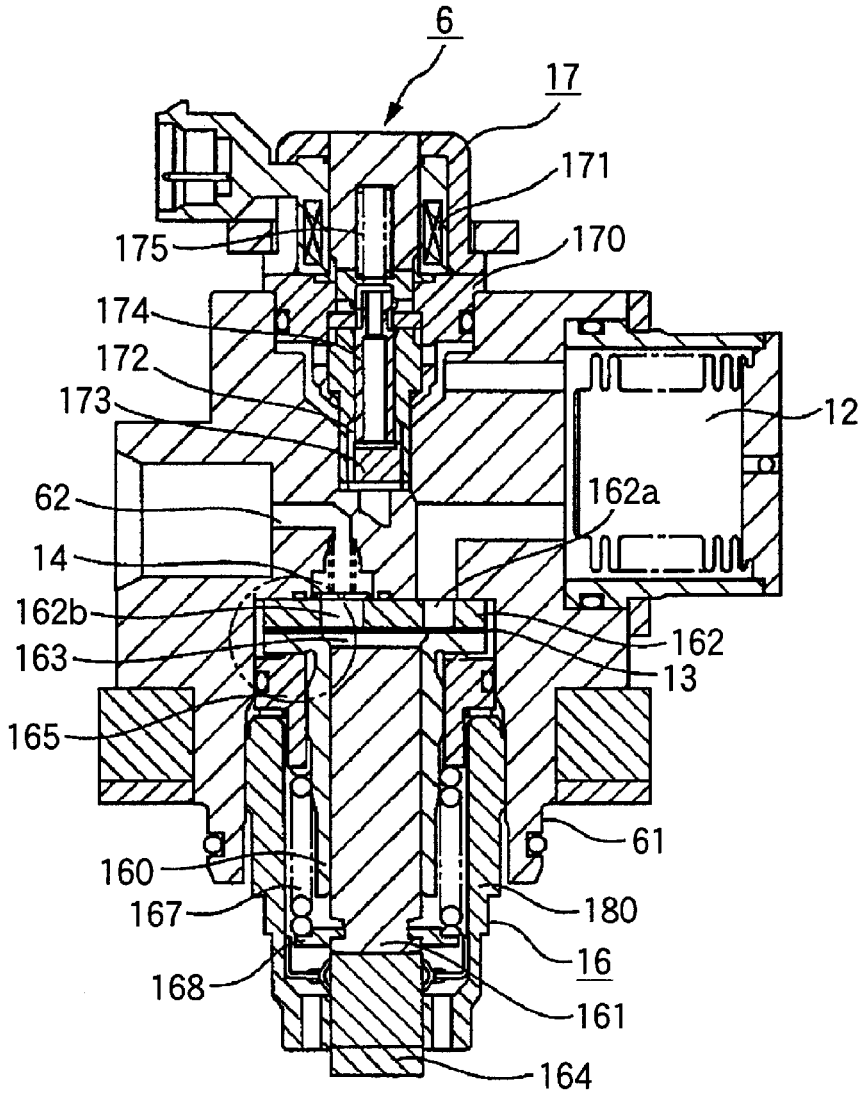
FIG. 9 is a sectional view showing a high pressure fuel supply apparatus according to Embodiment 4 of the present invention.
Figure 10:
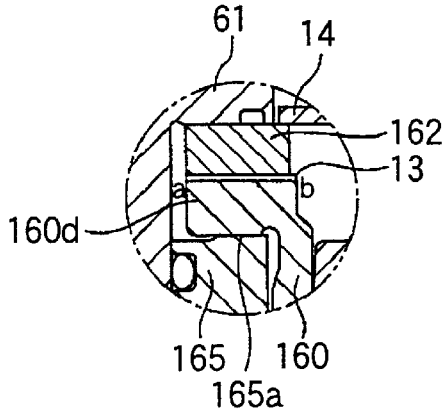
FIG. 10 is a sectional view in which the vicinity of a sleeve flange in a high pressure fuel pump of the high pressure fuel supply apparatus according to Embodiment 4 of the present invention is enlarged in scale.
Figure 11:
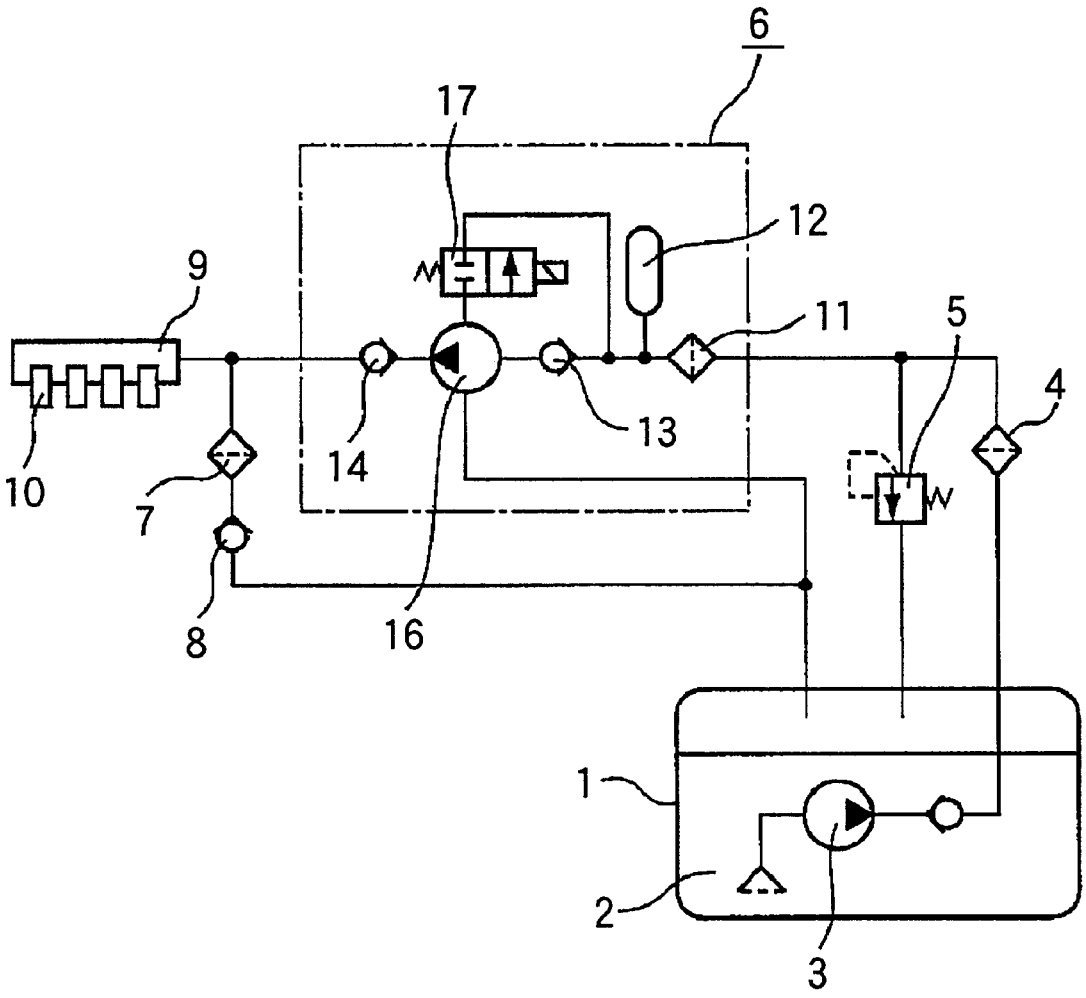
FIG. 11 is a block diagram showing a fuel supply system in an internal combustion engine for a vehicle, including a conventional high pressure fuel supply apparatus.
Figure 12:
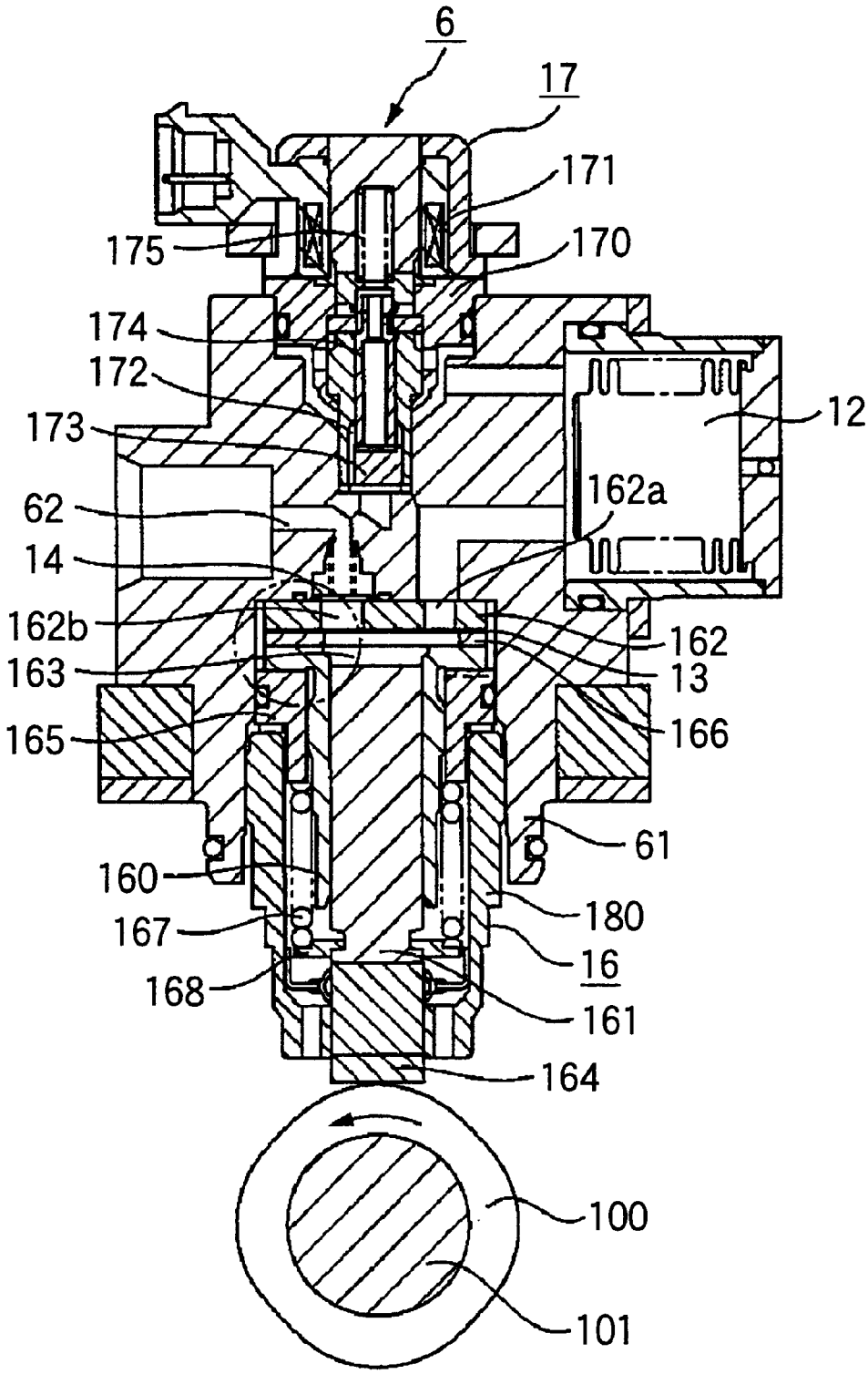
FIG. 12 is a sectional view showing a conventional high pressure fuel supply apparatus.
Figure 13:
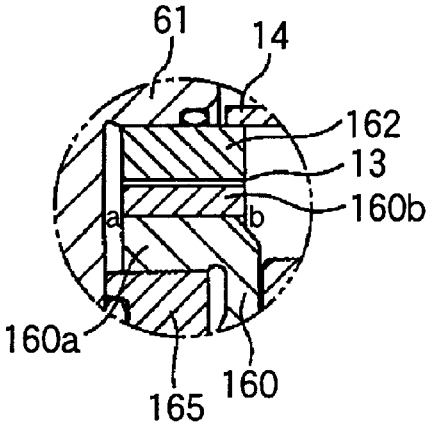
FIG. 13 is a sectional view in which the vicinity of a sleeve flange in a high pressure fuel pump of the conventional high pressure fuel supply apparatus is enlarged in scale.

FIG. 9 is a sectional view showing a high pressure fuel supply apparatus according to Embodiment 4 of the present invention. FIG. 10 is a sectional view in which the vicinity of a sleeve flange (inside the circle) in a high pressure fuel pump in FIG. 9 is enlarged in scale. As shown FIG. 10, the flange portion 160*a* of the sleeve 160 and the second plate 166 in the high pressure fuel pump in Embodiment 2 are integrally formed into a flange portion 160*d* in this embodiment. As a result, the surface pressure between a suction valve 13 and the flange portion 160*d* of the sleeve 160 can be made uniform between contact portions a and b. Thus, it is possible to obtain an effect similar to that in Embodiment 1, while the cost can be reduced due to reduction in the number of parts, and the number of portions from which fuel may leak can be reduced.

As described above, according to the present invention as stated in Aspect 1, there is provided a high pressure fuel supply apparatus including a plunger reciprocating in a sleeve of a high pressure fuel pump so as to form a fuel pressurizing chamber between the plunger and the sleeve, a first plate having a fuel suction port for sucking fuel into the fuel pressurizing chamber and a fuel discharge port for discharging the fuel from the fuel pressurizing chamber, and a suction valve provided in the fuel suction port, the first plate, the suction valve and a flange portion of the sleeve being held between a casing and an end surface of a predetermined member constituting the high pressure fuel pump, wherein an outer circumferential portion of the end surface of the predetermined member and an outer circumferential portion of the flange portion of the sleeve are designed not to abut against each other in a contact portion between the end portion of the predetermined member and the flange portion of the sleeve. Accordingly, the surface pressure in the contact portion between the flange portion of the sleeve and the suction valve becomes uniform, so that the leakage of fuel is prevented. Thus, there can be obtained an effect that the lowering of the fuel discharge quantity can be restrained particularly at the time of high pressure. In addition, because the surface pressure in the contact portion between the flange portion of the sleeve and the suction valve is uniform, there can be obtained an effect that wear due to fretting can be reduced. In addition, the present invention can be carried out without taking such measures that the sleeve is thickened, or a high-strength material is adopted to increase the fastening torque of the fastening bolt. Thus, there can be obtained an effect that a small-size and light-weight high pressure fuel supply apparatus can be obtained.

Further, according to the present invention as stated in Aspect 2, a second plate is provided between the sleeve and the suction valve. Accordingly, the surface pressure in the contact portion between the flange portion of the sleeve and the second plate becomes uniform so that the leakage of fuel is prevented. Thus, there can be obtained an effect that the lowering of the fuel discharge quantity can be restrained particularly at the time of high pressure. In addition, because the surface pressure in the contact portion between the flange portion of the sleeve and the second plate is uniform, there can be obtained an effect that wear due to fretting can be reduced. In addition, the present invention can be carried out without taking such measures that the sleeve and the second plate are thickened, or a high-strength material is adopted to increase the fastening torque of the fastening bolt. Thus, there can be obtained an effect that a small-size and light-weight high pressure fuel supply apparatus can be obtained.

Further, according to the present invention as stated in Aspect 3, the flange portion of the sleeve other than the outer circumferential portion is formed as a protrusion portion in the contact portion between the end portion of the predetermined member and the flange portion of the sleeve, so that the outer circumferential portion of the end surface of the predetermined member and the outer circumferential portion of the flange portion of the sleeve are designed not to abut against each other. Accordingly, the fuel is prevented from leakage. Thus, there can be obtained an effect that the lowering of the fuel discharge quantity can be restrained particularly at the time of high pressure.

Further, according to the present invention as stated in Aspect 4, the end surface of the predetermined member other than the outer circumferential portion is formed as a protrusion portion in the contact portion between the end portion of the predetermined member and the flange portion of the sleeve, so that the outer circumferential portion of the end surface of the predetermined member and the outer circumferential portion of the flange portion of the sleeve are designed not to abut against each other. Accordingly, the fuel is prevented from leakage. Thus, there can be obtained an effect that the lowering of the fuel discharge quantity can be restrained particularly at the time of high pressure.

What is claimed is:

1. A high pressure fuel supply apparatus comprising:

a plunger reciprocating in a sleeve of a high pressure fuel pump so as to form a fuel pressurizing chamber between said plunger and said sleeve, a first plate having a fuel suction port for sucking fuel into said fuel pressurizing chamber and a fuel discharge port for discharging said fuel from said fuel pressurizing chamber, and a suction valve provided in said fuel suction port, said first plate, said suction valve and a flange portion of said sleeve being held between a casing and an end surface of a predetermined member constituting said high pressure fuel pump, wherein an outer circumferential portion of said end surface of said predetermined member and an outer circumferential portion of said flange portion of said sleeve are designed not to abut against each other in a contact portion between said end portion of said predetermined member and said flange portion of said sleeve.

2. The high pressure fuel supply apparatus according to claim 1, further comprising:

a second plate provided between said sleeve and said suction valve.

3. The high pressure fuel supply apparatus according to claim 1, wherein said flange portion of said sleeve other than said outer circumferential portion is formed as a protrusion portion in said contact portion between said end portion of said predetermined member and said flange portion of said sleeve, so that said outer circumferential portion of said end surface of said predetermined member and said outer circumferential portion of said flange portion of said sleeve are designed not to abut against each other.

4. The high pressure fuel supply apparatus according to claim 1, wherein said end surface of said predetermined member other than said outer circumferential portion is formed as a protrusion portion in said contact portion between said end portion of said predetermined member and said flange portion of said sleeve, so that said outer circumferential portion of said end surface of said predetermined member and said outer circumferential portion of said flange portion of said sleeve are designed not to abut against each other.

5. The high pressure fuel supply apparatus according to claim 3, wherein said flange portion of said sleeve and said second plate are integrally formed.

6. The high pressure fuel supply apparatus according to claim 4, wherein said flange portion of said sleeve and said second plate are integrally formed.

* * * * *